US006305263B1

(12) United States Patent
Wallin

(10) Patent No.: US 6,305,263 B1
(45) Date of Patent: Oct. 23, 2001

(54) APPENDED POD UNDERWATER GUN MOUNT

(75) Inventor: C. Roger Wallin, Portsmouth, RI (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/515,216

(22) Filed: Feb. 28, 2000

(51) Int. Cl.[7] ..... F41F 3/08; F41F 3/10; F41F 3/00; F41A 23/00; B63G 8/28

(52) U.S. Cl. ..... 89/5; 89/1.809; 89/1.81; 89/37.06; 114/316; 114/239

(58) Field of Search ..... 89/5, 1.809, 1.81, 89/37.06; 114/316, 238, 239

(56) References Cited

U.S. PATENT DOCUMENTS

| | | | | |
|---|---|---|---|---|
| 1,303,266 | * | 5/1919 | Kennedy | 114/316 |
| 1,349,414 | * | 8/1920 | Kennedy | 89/1.701 |
| 1,356,294 | * | 10/1920 | Kuhajda | 89/38 |
| 1,512,435 | * | 10/1924 | Waninger | 89/37.06 |
| 1,542,970 | * | 6/1925 | Spear | 89/37.06 |
| 1,781,175 | * | 11/1930 | Grieshaber | 89/37.06 |
| 3,368,510 | * | 2/1968 | Humphrey | 114/317 |
| 3,875,844 | | 4/1975 | Hicks . | |
| 3,969,977 | * | 7/1976 | Opdahl et al. | 89/1.81 |
| 4,215,630 | | 8/1980 | Hagelberg et al. . | |
| 4,855,961 | | 8/1989 | Jaffe et al. . | |
| 5,187,318 | * | 2/1993 | Sanderson et al. | 89/37.22 |
| 5,208,422 | * | 5/1993 | Moody | 89/1.809 |
| 5,341,718 | | 8/1994 | Woodall, Jr. et al. . | |
| 5,677,506 | * | 10/1997 | Wallin | 89/38 |
| 5,695,202 | * | 12/1997 | Cartwright et al. | 277/636 |
| 5,911,172 | * | 6/1999 | Korolenko | 89/5 |

* cited by examiner

*Primary Examiner*—Charles T. Jordan
*Assistant Examiner*—John W. Zerr
(74) *Attorney, Agent, or Firm*—Michael J. McGowan; Prithvi C. Lall; Michael F. Oglo

(57) ABSTRACT

An appended pod underwater gun mount for a submersible host vessel includes a strut member having a base end fixed to an outer hull of the submersible host vessel and a distal end protruding outwardly from the host vessel, the distal end being angled with respect to the base end, and an ammunition housing moveably fixed to the distal end of the strut member. A train control mechanism is positioned between the strut member and the ammunition housing for controlling the horizontal rotation of the ammunition housing with respect to the host vessel, and a tilt control mechanism is positioned between the strut member and the ammunition housing for controlling the vertical rotation of the ammunition housing with respect to the host vessel. A flexible boot is connected to the ammunition housing and surrounds each of the train control mechanism and the tilt control mechanism to protect the mechanisms from an underwater environment. The ammunition housing is movable both vertically and horizontally with respect to the distal end of the strut member and is spaced apart from the host vessel so as to avoid contacting the host vessel during directional movement of the ammunition housing.

23 Claims, 10 Drawing Sheets

AZIMUTH SECTOR OF UNDERWATER GUNFIRE FIELD

APPENDED POD UNDERWATER GUN MOUNT

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION (1) Field of the Invention

This invention generally relates to an appended underwater gun mount. More particularly, the invention relates to an appended underwater gun mount for both mounting and controlling an underwater gun so as to be able to engage and destroy attacking torpedoes.

(2) Description of the Prior Art

The current art for anti-torpedo devices is under investigation by Naval engineers in several countries who are investigating the technical and operational problems associated with torpedo defense. Efforts to defend ships and submarines against attacking torpedoes have resulted in a number of concepts for inclusion within shipboard Torpedo Defense Systems (TDS). Those concepts include sensors for detecting the sound of an incoming torpedo, development of recommended evasive maneuvers to avoid such a weapon, deployment of countermeasures to decoy the torpedo, and anti-torpedo weapons to destroy it before it strikes its intended target. Anti-torpedo weapons that are being investigated or developed include guns that are capable of firing underwater. Typically, these are medium caliber, projectile firing guns that can launch a stream of bullet-like objects at a very high velocity in rapid sequence. Such guns are envisioned as being used underwater against attacking torpedoes in a manner similar to anti-air missile systems such as the PHALANX close in weapons system (CIWS) against incoming airborne missiles.

The concept of using an underwater "machine gun" to destroy an attacking torpedo is appealing because it provides a positive and conclusive defensive response to such a situation. If the direction, or bearing, of an incoming torpedo is determined by a sensor on board a targeted vessel, requisite response action is to aim the gun and direct the release of its projectiles towards the threat. That process, however, is a complex function, composed of the combination of inter-related launcher, fire control, and operability issues that are all technically challenging. The first is the problem of providing a suitable launcher, or mounting apparatus, for containment of the gun and its ammunition. The gun mount must be capable of being controlled or moved into a position that will point the barrel of the gun towards an attacking torpedo, in accordance with an appropriate fire control solution.

Since projectiles fired from an underwater gun, or any type of conventional gun, are not controllable after release, the physical position of the gun barrel determines the direction subsequently taken by the shot. Bullets shot from guns are "unguided missiles", subject to ballistic influences such as gravity, drag, and the like, after leaving the barrel. Therefore, the gun mount must have sufficient flexibility of movement to allow the muzzle of the gun to be pointed towards any direction from which a torpedo attack is probable.

While a torpedo may strike any part of the hull of a targeted vessel, it is generally considered that the area of greatest danger from a modern torpedo is astern. One reason is that the stern of a ship, or a submarine, is the location of the screw(s) or propulsors that drive it through the water. A great deal of energy (acoustic and other) is transferred from the vessel to the surrounding medium at that location. Modern torpedoes are designed to sense and seek such energy, and thus, a homing torpedo is likely to attack from astern, unless measures have been taken, and have been successful, to eliminate that stimulus.

Another reason for expecting a torpedo attack from astern is that a common tactic for any ship, if alerted to impending danger, is to turn away from an incoming weapon. That is a natural reaction, and it is logical to minimize the relative velocity between a weapon and its target by attempting to outrun it. Also, turning away from the torpedo presents a much smaller aspect or cross section. Therefore, the ship's own maneuvers may steer the danger area, intentionally, to the stern.

Accordingly, a need in the art exists in which an anti-torpedo gun must be able to deploy a field of fire that fills a conical volume of space astern of a vessel that is host to such a defensive system. An obvious problem with respect to implementation of that capability is that the stern of a ship is the location of control and propulsion mechanisms that would be in the way of any hull mounted launcher aimed astern. Location of a gun mount aft of those mechanisms is impractical, because the stream of gunfire would issue directly into the turbulence of the ship's wake. A gun mount configured as a towed body would also be impractical, because the precise location and attitude of the module would be variable and uncertain, and deployment would be difficult. Accordingly, it is the inventor's discovery that the functional capability that is needed to engage attacking torpedoes is a hull mounted, controllable gun mount that can fire past, or around, the screws and control surfaces of the host vessel.

The following patents, for example, disclose various types of anti-torpedo devices, but do not disclose a hull mounted, controllable gun mount that can fire past, or around the screws and control surfaces of the host vessel.

U.S. Pat. No. 3,875,844 to Hicks;

U.S. Pat. No. 4,215,630 to Hagelberg et al.;

U.S. Pat. No. 4,855,961 to Jaffe et al; and

U.S. Pat. No. 5,341,718 to Woodall, Jr. et al.

Specifically, the patent to Hicks discloses an anti-torpedo system having, in combination, a radio frequency bridge having a source of radio frequency power connected thereto, a line of reference arranged at a predetermined distance from the vessel and parallel thereto, said reference line comprising an antenna disposed beneath and in contact with the water and abeam the vessel, means for applying a radio frequency current from said source to the antenna, the ends of one of the arms of said bridge being connected to the hull of the vessel and to said antenna respectively, said one arm including an electrically conductive path through the water between the antenna and said hull, means in at least one of the other arms for initially adjusting the bridge to an off balance condition, an output circuit for said bridge, a transformer in said output circuit, detector means operatively connected to the output of said transformer, a discharge tube having the control element thereof connected to the output of said detector means, the degree of initial unbalance of said bridge being insufficient to fire said tube, a plurality of explosive missiles, a plurality of guns aimed just beneath said line of reference for firing said missiles in the direction of the torpedo, and electro-responsive firing means on each of said guns operatively connected to the plate of said tube for firing the guns when a torpedo has approached said line of reference to a point substantially subjacent with respect thereto and thereby changed the impedance of the antenna circuit and the radio frequency current flowing therein sufficiently to fire said tube.

The patent to Hagelberg et al. discloses a ship anti-torpedo system including a detecting device for detecting and locating an incoming threat, such as a torpedo, and an interrelated missile launching and control system for firing at least one warhead carrying missile into the path of the oncoming threat, the missile having an active acoustic fuse system including a highly directional sensing system for continuously monitoring the position and proximity of the incoming threat and for detonating the warhead at the optimum proximity of the incoming threat with the missile. The missile floats at a predetermined depth determined by the predetermined depth of the torpedo to be intercepted.

Jaffe et al. discloses an imaging apparatus including an array of transmitters for simultaneously transmitting more than two coded signal beams in different directions to cover different regions of a field of view, said beams being modified by objects within said field of view, signal means for providing individual coded signals to respective transmitters, at least one receiver for simultaneously receiving plural coded modified signals derived from the coded signal beams, and a processor for separating the plural coded modified signals of different codes and processing them into an image signal.

Woodall, Jr. et al. discloses an acoustic decoy round ejected by a launcher for flight above water from a sea-going vessel, the round impacting at the water surface to cause separation of a payload from a forward section of the round that is also separated from a flotation anchor tethered to the payload and fins which stabilize launched flight of the round prior to impact. The separated payload submerges from the flotation anchor at the water surface location to a tethered depth within the water from which a decoy signal is emitted.

It should be understood that the present invention would in fact enhance the functionality of the above patents by providing a hull mounted, controllable gun mount that can fire past, or around, the screws and control surfaces of the host vessel so as to be able to engage and destroy attacking torpedoes.

SUMMARY OF THE INVENTION

Therefore it is an object of this invention to provide a hull mounted, controllable gun mount.

Another object of this invention is to provide a hull mounted, controllable gun mount for engaging and destroying attacking torpedoes.

Still another object of this invention is to provide a hull mounted, controllable gun mount which directs an unobstructed line of fire at objects, underwater, closing from astern of a host vessel.

A still further object of the invention is to provide a hull mounted, controllable gun mount which facilitates converging gun fire from two controllable gun mounts.

Another object of the invention is to provide forward and aft firing guns, co-located within the same gun mount.

Yet another object of this invention is to provide a hull mounted, controllable gun mount which is simple to manufacture and easy to use in any of a plurality of selected or necessary environments.

In accordance with one aspect of this invention, there is provided an appended pod underwater gun mount for a submersible host vessel. The appended pod underwater gun mount includes a strut member having a base end fixed to an outer hull of the submersible host vessel and a distal end protruding outwardly from the host vessel, the distal end being angled with respect to the base end, and an ammunition housing moveably fixed to the distal end of the strut member. A train control mechanism is positioned between the strut member and the ammunition housing for controlling the horizontal rotation of the ammunition housing with respect to the host vessel, and a tilt control mechanism is positioned between the strut member and the ammunition housing for controlling the vertical rotation of the ammunition housing with respect to the host vessel. A flexible boot is connected to the ammunition housing and surrounds each of the train control mechanism and the tilt control mechanism to protect the mechanisms from an underwater environment. The ammunition housing is movable both vertically and horizontally with respect to the distal end of the strut member and is spaced apart from the host vessel so as to avoid contacting the host vessel during directional movement of the ammunition housing.

BRIEF DESCRIPTION OF THE DRAWINGS

The appended claims particularly point out and distinctly claim the subject matter of this invention. The various objects, advantages and novel features of this invention will be more fully apparent from a reading of the following detailed description in conjunction with the accompanying drawings in which like reference numerals refer to like parts, and in which:

DESCRIPTION OF THE PREFERRED EMBODIMENT

In general, the present invention is directed to the mounting and control of an underwater gun so as to be able to engage and destroy attacking torpedoes. Other applications, including the use of the concept as a launcher for submarine anti-aircraft ordnance, are intended.

Referring first to FIGS. 1 through 4, primary features of a first preferred embodiment of the subject invention are shown.

Figure 1:
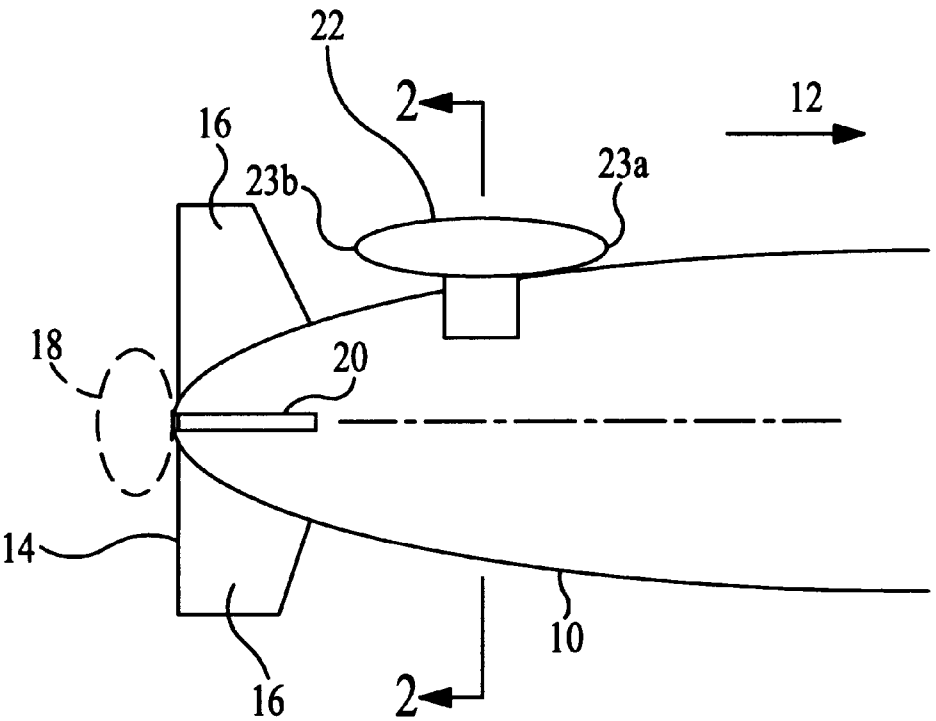
FIG. 1 is a side plan view of a first preferred embodiment of the present invention showing a partial submarine hull having an appended pod underwater gun mount fixed thereto.

FIG. 1 is a side plan view of a portion of a submarine hull 10 having a fore end 12 (not entirely shown) and an aft end 14. A rudder 16 is vertically mounted with respect to an upright orientation of the submarine and adjacent the aft end 14 of the submarine hull 10, and a screw 18 or other known propulsion system is mounted at the aft end 14 of the submarine hull 10 behind the rudder 16. Stern planes 20 are horizontally mounted with respect to an upright orientation of the submarine and such that the stern planes 20 are perpendicular to the rudder 16.

At least one appended pod underwater gun mount 22, encompassing the subject matter of the present invention, is mounted to the submarine hull 10 in a position with respect thereto as shown. The appended pod underwater gun mount 22 includes a fore end 23*a* and aft end 23*b* corresponding to the fore and aft ends of the submarine hull 10.

Figure 2:
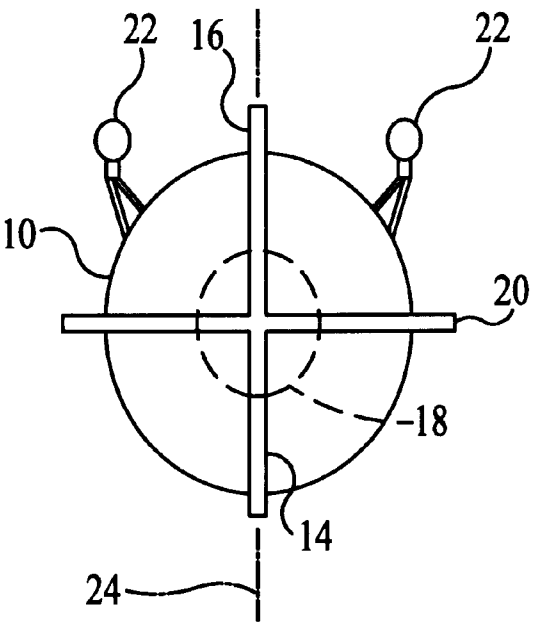
FIG. 2 is a cross sectional view taken along line 2—2 of FIG. 1 showing appended gun mount locations.

FIG. 2 is a cross sectional view taken along lines 2—2 of FIG. 1 and showing a stern view of the submarine hull 10 with two appended underwater gun mounts 22 mounted thereto.

More specifically, in FIG. 2, the stern view of the submarine hull 10 shows the location of two appended pod gun mounts 22 located symmetrically at a radial distance from a centerline 24 of the ship, and substantially greater than the radius of the hull 10. The aft ends 22*b* of the pod mounts 22 thereby can be directed down as well as up and outwards without interference from the ship's hull 10. At least one gun 26 (described in further detail below) is located along a longitudinal axis of each pod 22, and will be capable of firing through a quadrant of space between rudders 16 and the stern planes 20, and thus the critical zone of danger from attacking torpedoes, astern of the submarine, can be defended with a comprehensive field of gunfire.

Figure 3:
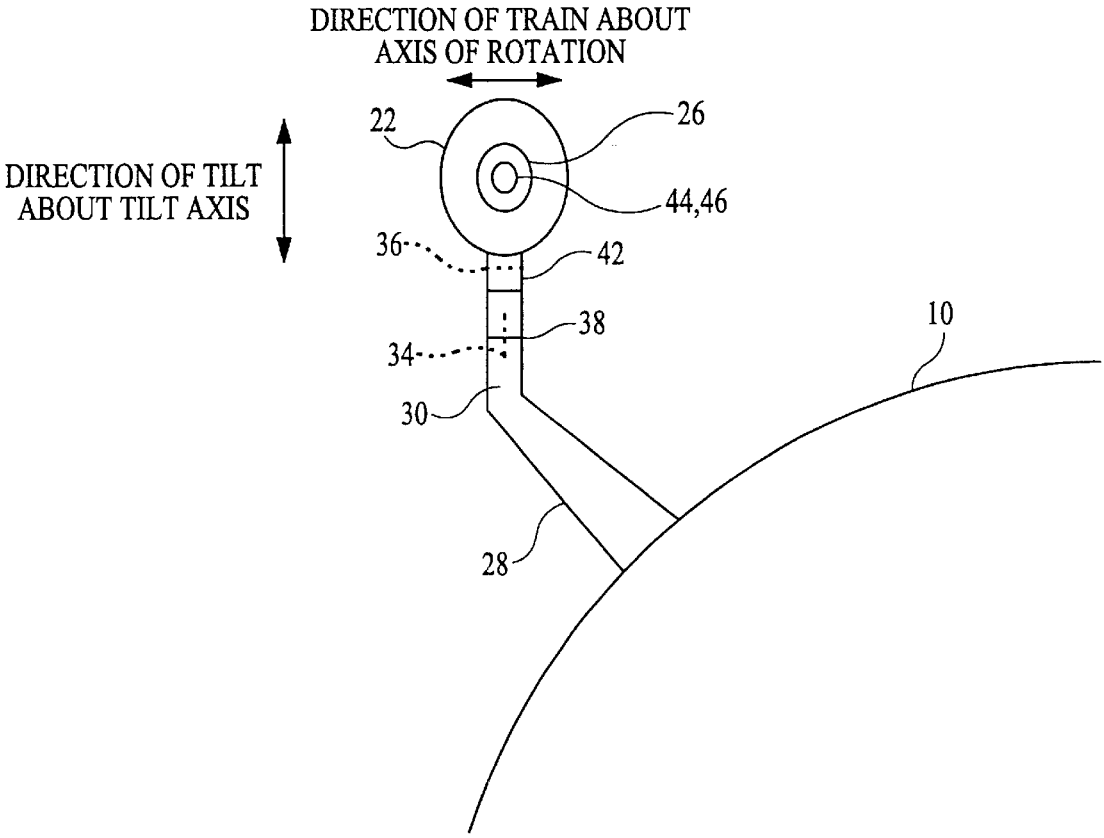
FIG. 3 is an expanded and partial sectional view of an appended pod gun mount according to the first preferred embodiment of the present invention.
Figure 4:
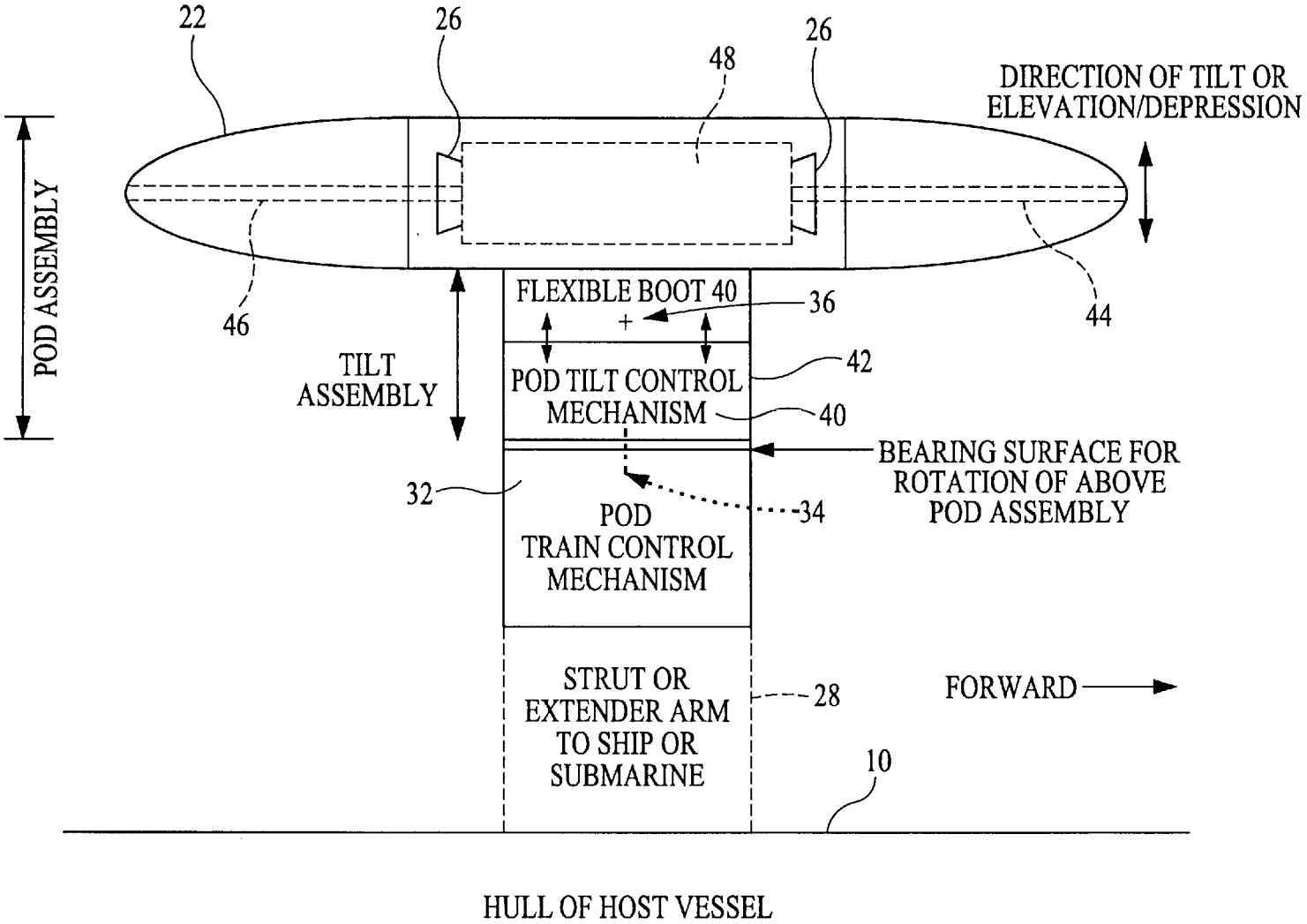
FIG. 4 is a detailed view of the appended pod underwater gun mount according to the first preferred embodiment of the present invention.

Turning now to FIG. 3, there is shown an enlarged and partial cross-sectional view of an appended pod underwater gun mount 22 and major features thereof for connection to the hull 10 of the submarine. FIG. 4 is a side schematic view further illustrating the components of the appended pod underwater gun mount 22. The appended pod underwater gun mount 22 is generally cylindrical in shape. The shape necessarily lends itself to a streamlined and fluid dynamic outward surface. In other applications, it is understood that the shape thereof may vary. The cylindrical appended pod gun mount 22 is controllable in train and elevation (tilt), similar to traditional gun mounts or turrets, but it is unique because of its form and the means by which it is joined to its host vessel. The size of the cylindrical pod 22 will be dependent on the specific number and types of weapons to be mounted within it. However, a representative application may be envisioned as a module about 20 feet in length and 3 feet in diameter.

More specifically, the pod 22 is attached to the hull 10 of a submarine as an appendage or offset structure. Rather than being attached directly to or through the hull 10 of the submarine, as a traditional turret would be, the appended pod 22 is removed several feet away from the hull 10 where it realizes the advantage of effectively being somewhat apart from the ship, while actually being integral with it and its travel. Thus, each appended pod gun mount 22 is attached to the hull 10 of a submarine or the like by a strong horn or strut 28 that extends outward and upward from the hull 10, near the stern 14 but forward of the rudders 16 and stern planes 20. The strut 28 is streamlined in cross section, as is the pod assembly, to minimize hydrodynamic drag. The strut 28 emerges from the hull surface 10 in a radial direction, but an outer end 30 thereof is bent upward so that a train control mechanism 32 will operate to turn the pod 22 in a horizontal plane and a tilt control mechanism 40 will operate to turn the pod 22 about a vertical plane when the ship is level. That is, a train axis 34 is at or nearly vertical and a tilt axis 36 is horizontal when the submarine is trimmed for operation at any constant depth. The horizontal motion given by this mechanism is identified as "train" in the language of naval gun mounts and turrets, and therefore is used here for consistency of terminology. On a submarine, a distance between outboard sides of the two symmetrical appended pod gun mounts 22 is kept slightly less than the beam of the ship at that location, so as to avoid interference with any object that is alongside of the vessel when in port.

The cylindrical pod 22 and its supporting tilt assembly rest on a bearing surface 38 where there is a motor or similar mechanism associated with the pod train control mechanism 32. The tilt assembly including the tilt control mechanism 40 will direct the entire appended pod gun mount 22 to be rotated clockwise or counterclockwise (in FIG. 4) in accordance with remote control signals from within the host vessel.

The pod train control mechanism 32 is positioned below the bearing surface 38. The amount of train may be limited by a particular application, in order to minimize the flow resistance presented by the side of the pod 22 that faces forward when trained off centerline. For a torpedo defense application, an angle of 30 degrees clockwise or counterclockwise is likely to be adequate. In all applications, it is intended that the pod mounts 22 be stabilized by fire control orders that compensate for ship motion such as roll and pitch.

Further, a flexible boot 42 surrounds the entirety of the tilt axis 36, the pod tilt control mechanism 40 and the pod train control mechanism 32. The flexible boot 42 or collar encloses the space between the pod 22 and the tilt assembly 40 to form a streamlined outer configuration. The space inside the flexible boot 42 or collar may be pressurized or free flooding to maintain its flexibility at any depth.

Referring further to the detail shown in FIG. 4 the appended pod 22 particularly includes forward 44 and aft 46 facing gun barrels, and at least one ammunition magazine 48, within a cylindrical enclosure, tapered at each end to a streamlined, spindle shape.

Figure 5:
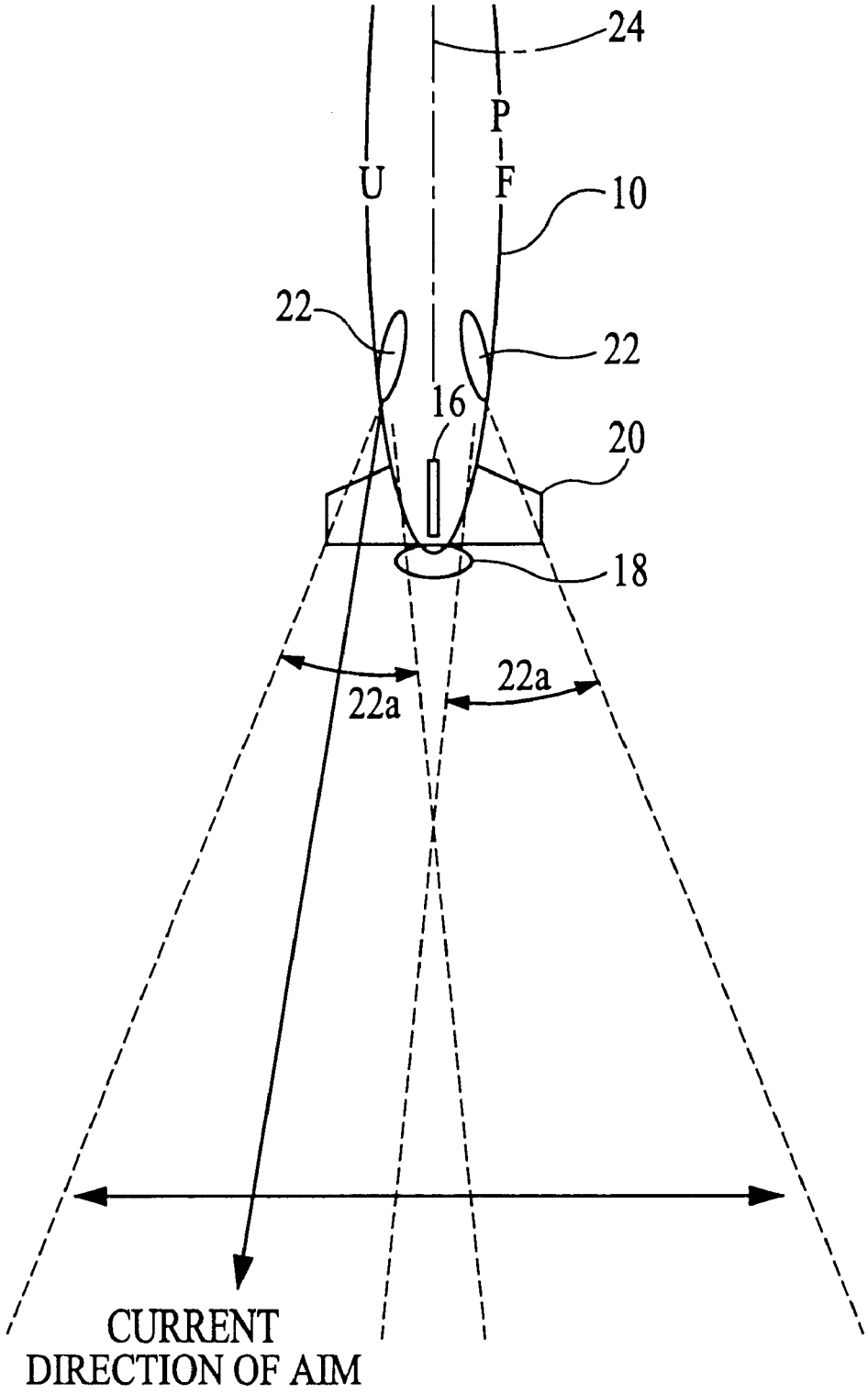
FIG. 5 is a top plan view illustrating a comprehensive planar field of fire for a pair of appended pod underwater gun mounts according to the present invention.
Figure 6:
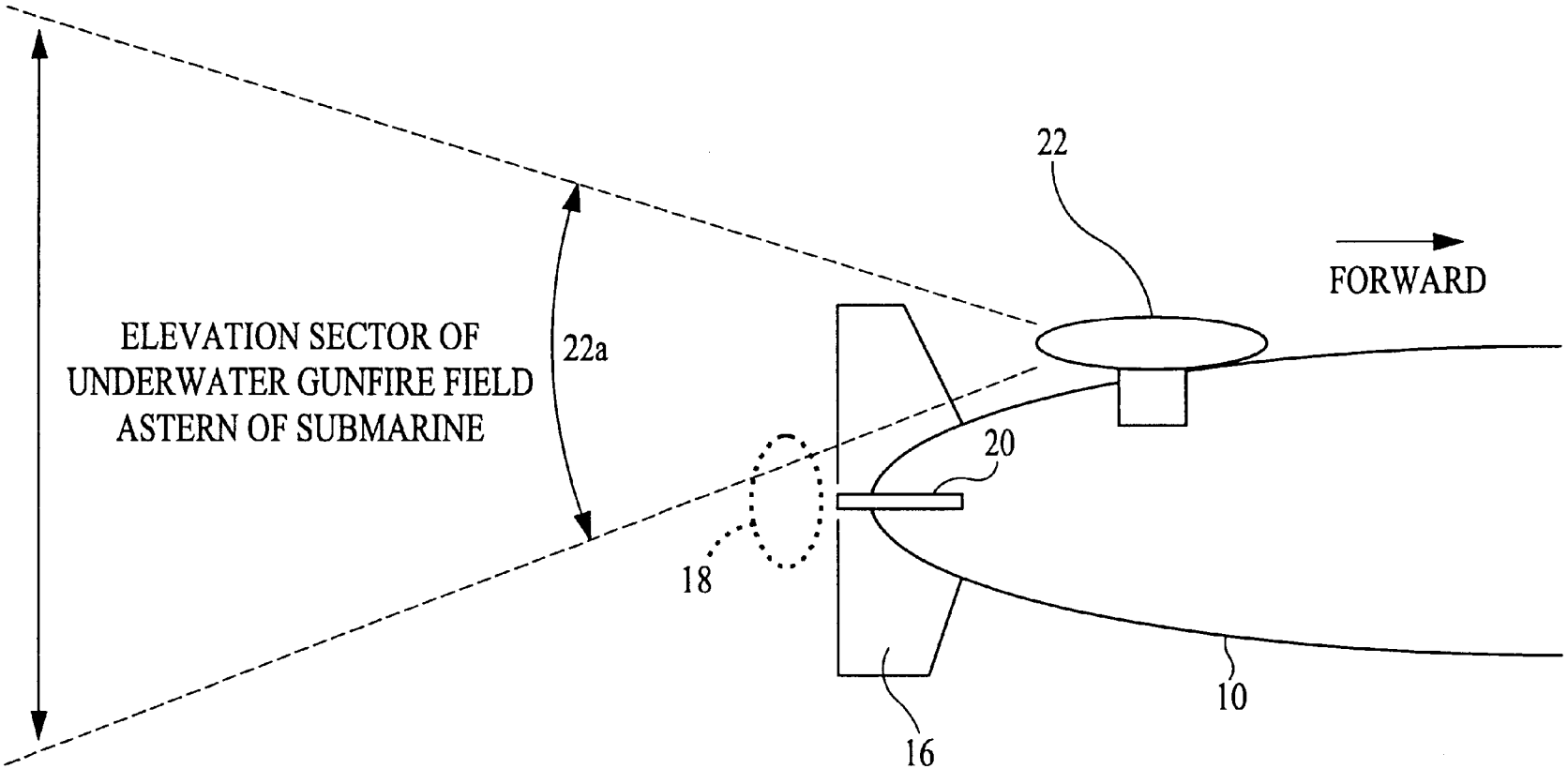
FIG. 6 is a side plan view illustrating a comprehensive vertical field of fire for an appended pod underwater gun mount according to the present invention.

FIGS. 5 and 6 illustrate the advantage provided by the appended pod gun mounts 22 in achieving a comprehensive field of fire (denoted by dashed lines 22*a*) to engage torpedoes approaching from astern. A pair of pods 22 can be mounted so that the field of fire from each of the aft facing guns 26 or gun barrels 46 overlaps the other, and it is thereby possible to engage attacking torpedoes by converging streams of projectiles that increase the overall defensive power of the guns 26 or gun barrels 46. That is possible because of the unique offset arrangement of the two mounts 22.

A secondary area of danger from attacking torpedoes is from ahead of the targeted vessel. The threat of an impending torpedo attack may be reduced by turning towards an incoming weapon as well as away from it, because of reduced aspect. Therefore, it is desirable that an anti-torpedo gun be able to fire ahead at weapons approaching the bow, as well as astern. The present invention succeeds in realizing that goal because of the combination of the previously described offset mounting and by the unique concept of having both forward 44 and aft facing 46 gun barrels within the same pod mount 22.

Figure 7:
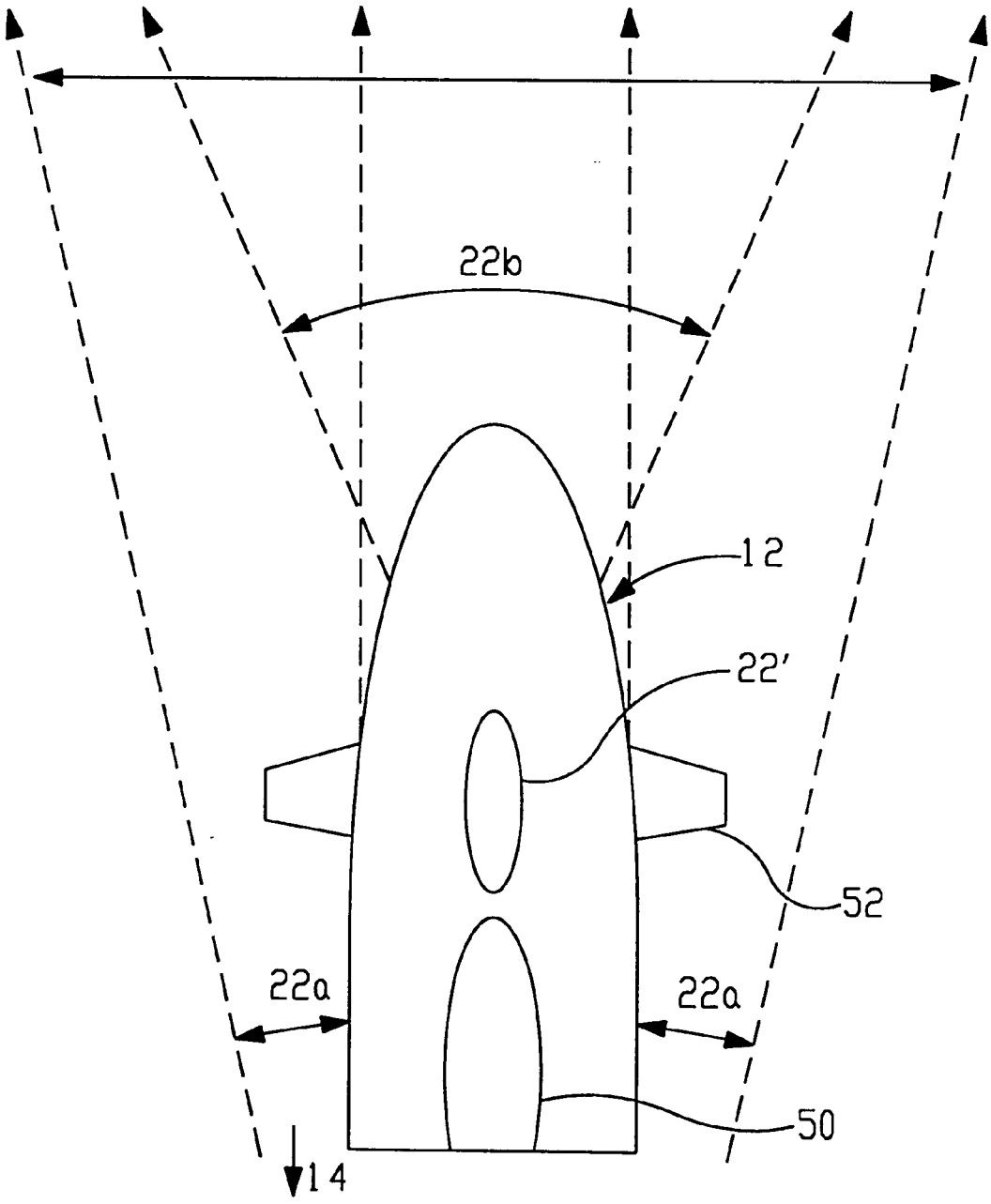
FIG. 7 is a top plan view illustrating a further appended pod underwater gun mount location and related field of fire according to the present invention.

FIG. 7 shows that each of the pod mounts 22 located near the stern 14 of a submarine can also effect a field of fire 22*a* that is forward and to the outboard side of the ship. A narrow area directly ahead of the ship remains to be guarded, and the proposed solution is to mount a third pod 22' on the centerline 24 of the forward end 12 of the submarine, directly forward of a "sail" structure 50 and substantially aligned with bow planes 52 of the vessel. Thereby, the area forward of the submarine will be completely defended as shown by the field of fire 22*b* of the third pod 22'.

Figure 8:
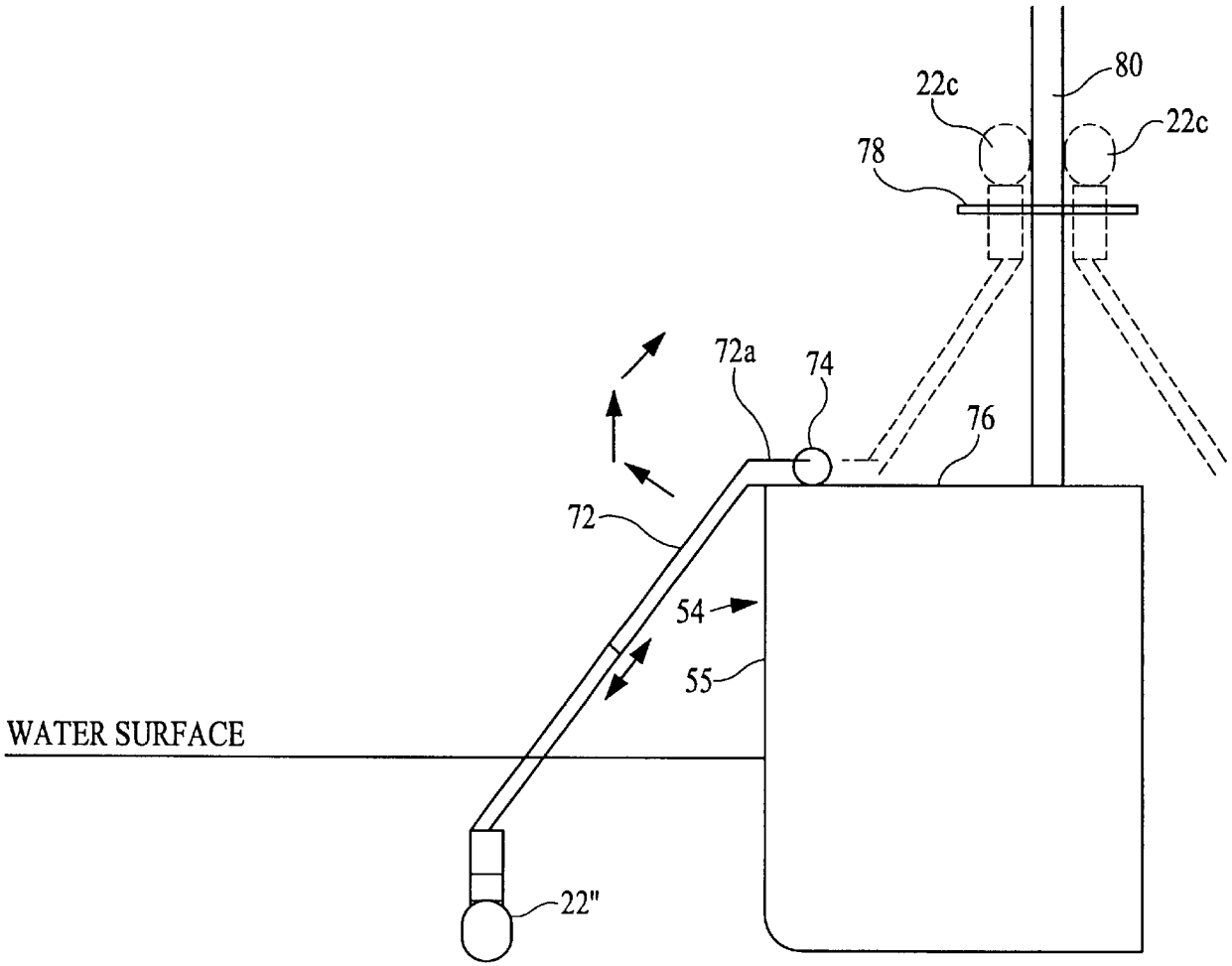
FIG. 8 is a typical surface ship implementation for a deployed appended pod underwater gun mount according to a second preferred embodiment of the present invention.

A major advantage for the subject invention is that it can be applied to the defense of both surface ships and submarines. Accordingly, a typical surface ship implementation is shown in FIG. 8. In the case of a surface ship 54, it would not be practical to mount the pods 22 permanently and offset to the sides of the ship because they would interfere with mooring the vessel in port. Consequently, the preferred embodiment of the invention when applied to a surface installation is to mount pods 22" on the ends of extender arms 72, which function similar to the struts 28 on the submarine to hold the pods 22" at some distance away from the hull 55 of the ship 54 and clear of the propellers (not shown). The extender arms are configured so as to be axially extendable and able to lift the pod mounts 22" out of the water and on board the host vessel to a stowed position (indicated by dashed outline 22*c*) when not needed. In order to successfully maneuver the extender arms 72, a pivot member 74 is mounted on a deck 76 of the ship 54 and a base end 72*a* of the extender arm 72 is connected thereto. Withdrawal of the extender arm 72 and pod 22" results in a pivot of about 180 degrees to place in a stowed position 22*c* on the deck 76. Stowage is contemplated to include a platform 78 attached to a mast 80 mounted on the deck 76 of the ship 54. Any known method of connecting to the platform 78 is considered to be within the scope of the invention. Finally, manual or automated actuation of the extender arms 72 is achieved according to a preferred system of the vessel.

Figure 9:
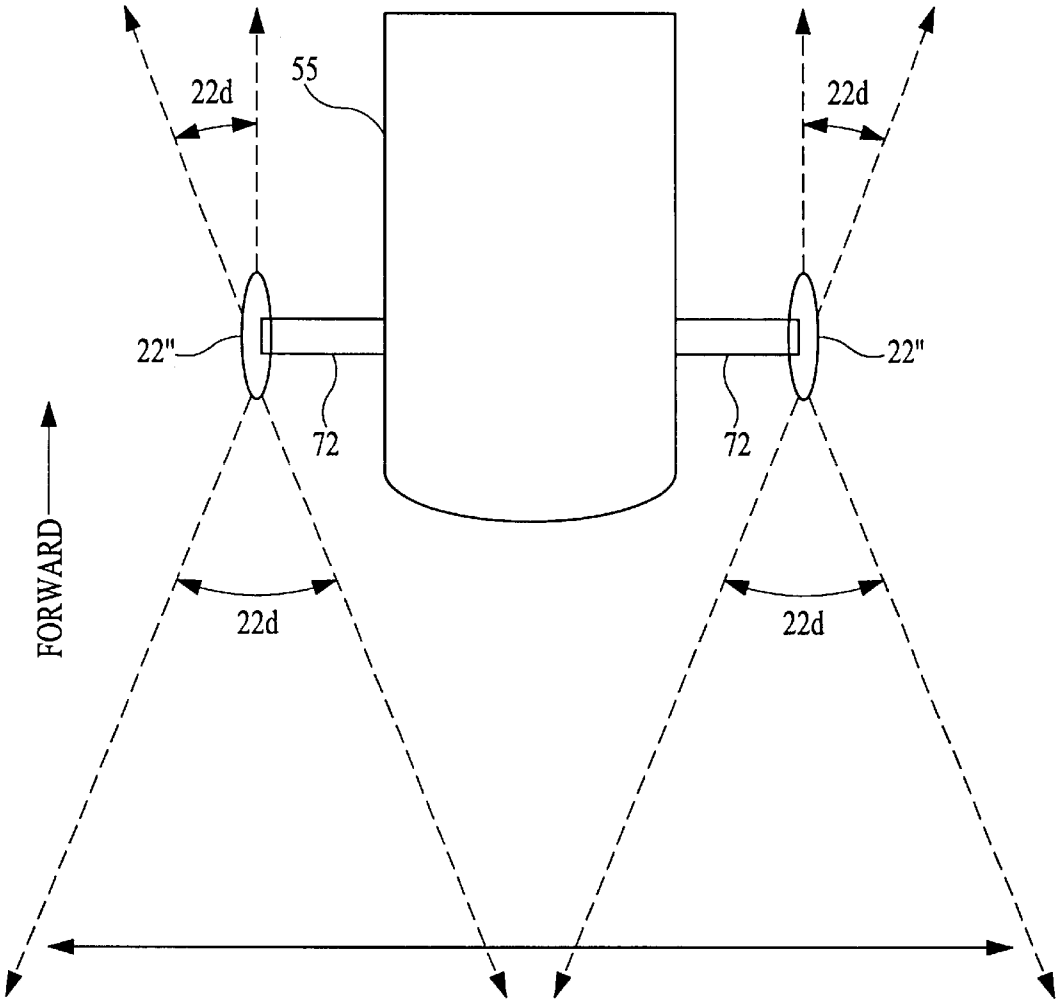
FIG. 9 is a top plan view illustrating a field of gunfire achievable by a pair of appended pod underwater guns according to the embodiment shown in FIG. 8.

The field of gunfire that can be achieved by a pair of appended pod underwater guns 22" for defense astern of a surface ship is shown in the top plan view of FIG. 9 (dashed lines 22*d*). Since the pods 22", when deployed, will be positioned just a few feet below the surface of the water, there will be little requirement for tilt except for some downward angle. The surface problem is closer to being a two dimensional situation than the submarine case, where torpedoes may threaten from above as well as below the targeted vessel. The surface pod mount installation shown in FIG. 9 will also provide some degree of protection against torpedoes attacking from forward, but a more practical and thorough defense ahead would be realized by mounting another pair of extended pods on either side of the surface ship near the bow. The use of a single, third pod, on an extender arm (not shown) directly forward of the bow is a possible alternative, but it would be more difficult to implement because of the effect of ship pitch motion which would tend to lift the pod out of the water at times.

A significant advantage associated with the appended pod gun mounts 22 is that in all of the installations described, access to the mounts for arming and servicing can be done above water. While the gun mounts are designed for tactical use underwater, they are readily available in the open environment to ship crews while in port or in transit. On a submarine, they are fixed at positions well above the ship's waterline when surfaced. On a surface ship, the pod mounts are designed to be brought aboard for stowage and maintenance. While intended for underwater use, the underwater pod mounts do not have to endure the rigors of a constant underwater environment.

The appended pod underwater gun mount 22 was inspired by the primary need to engage torpedoes that attack a ship or submarine from astern. A torpedo encounter may take place or continue to a very short range, and it is essential that a defensive stream of gunfire can be sustained, unhindered by ship structures, as long as possible in that scenario. The appended pod mount concept enables that functionality, but it has further potential. In addition to torpedo defense, the appended pod concept can be extended to support several other useful applications.

Figure 10:
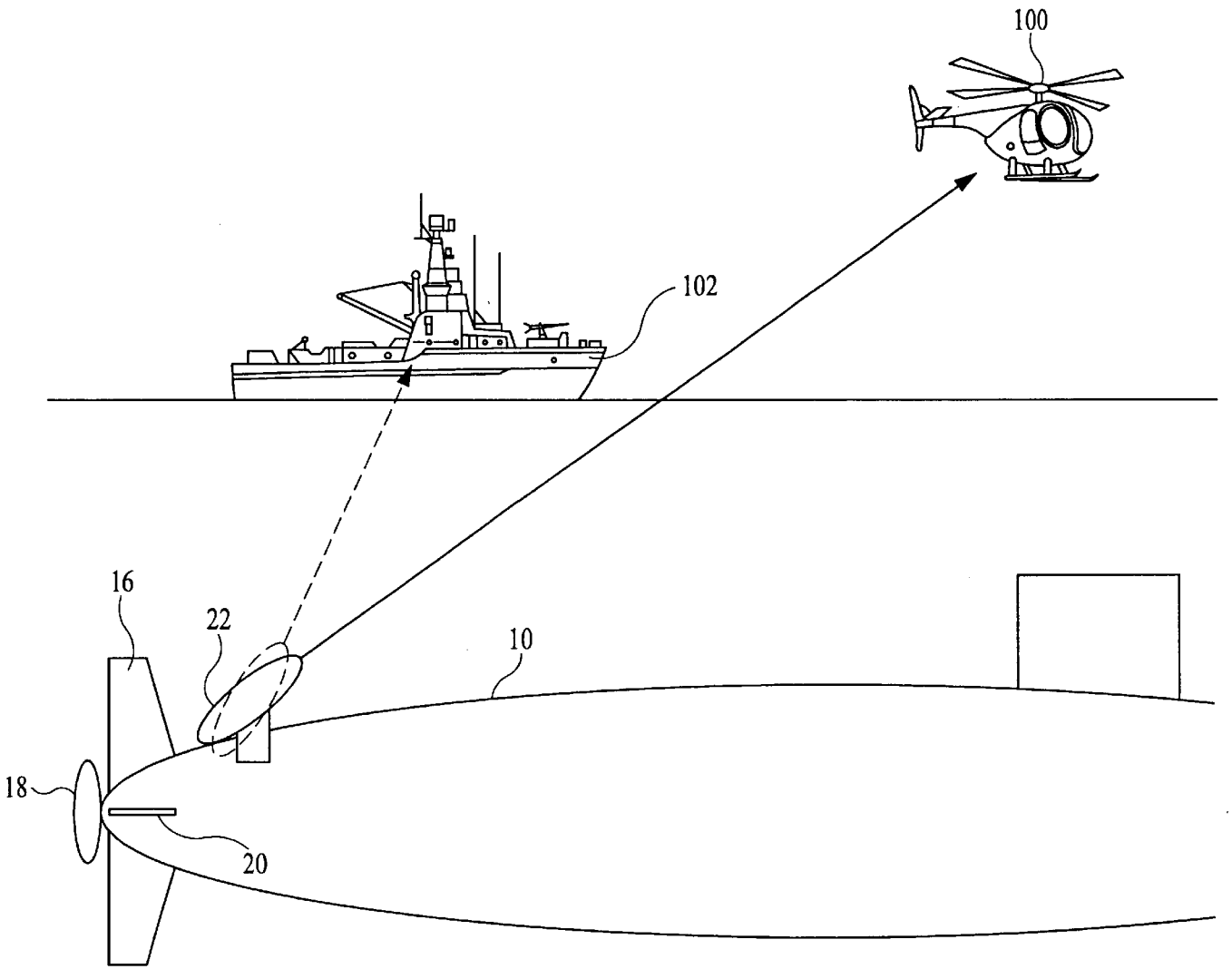
FIG. 10 illustrates two applications of the appended pod underwater mount according to the first preferred embodiment of the present invention.

FIG. 10 illustrates the use of an appended pod 22 as either an underwater gun mount or missile launcher to support submarine defense against aircraft 100 or small ships 102 at close range. Such situations may be of particular concern if a submarine is required to operate in shallow water. An appended pod mount 22, in a position above the hull of a submarine, can be trained and elevated to point in any direction above the host vessel to deploy ordnance or other devices. The pod mount 22 can serve as a self contained magazine and launcher, with no passage requirement from within the submarine except power and remote fire control signals. Finally, the underwater pod mount 22 can be considered for use as a storage and launching mechanism for other devices deployed in the oceans. Included would be various types of countermeasures, sonobuoys, and miscellaneous objects requiring covert deployment.

Figure 11:
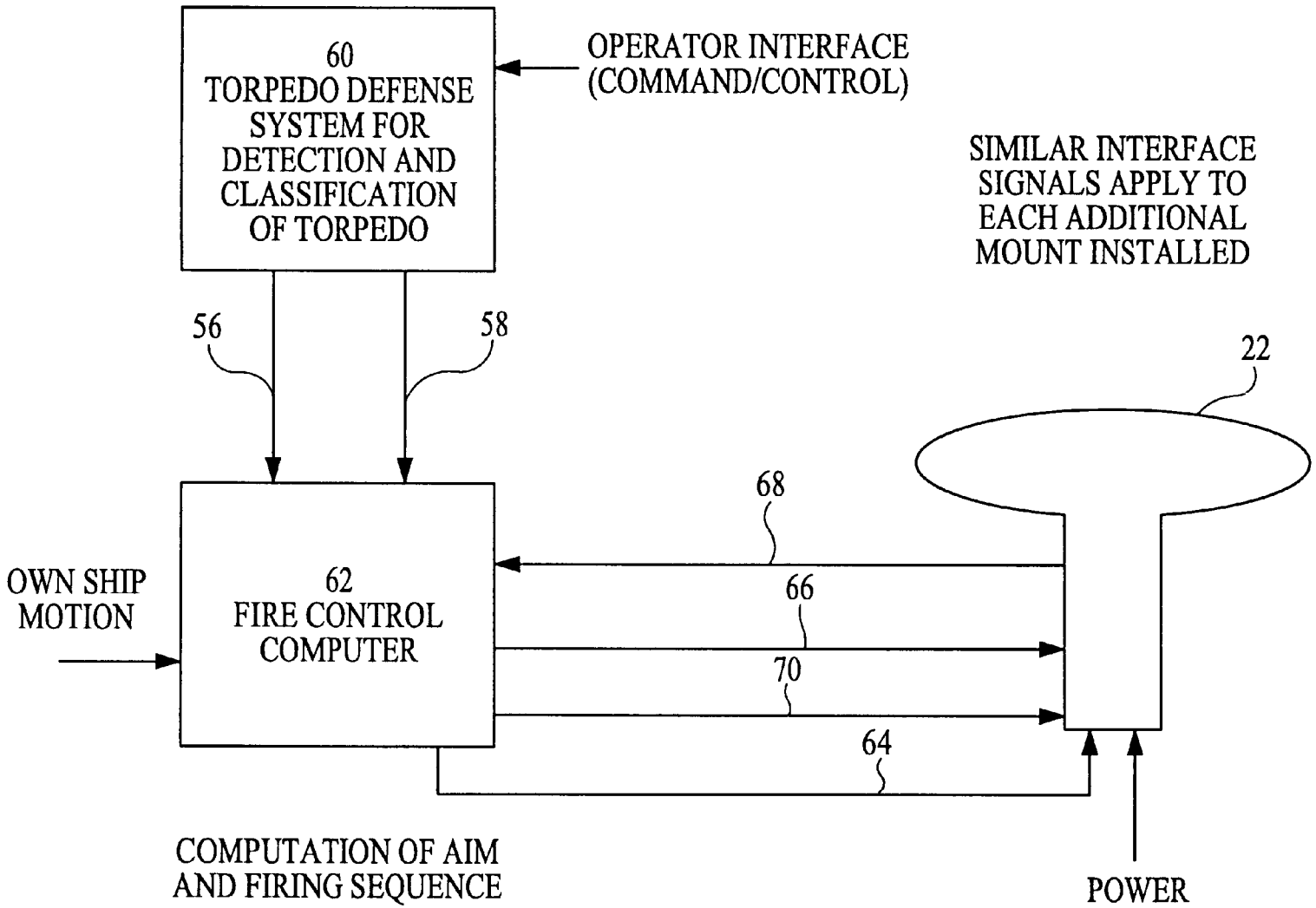
FIG. 11 diagrammatically illustrates system integration and operation of the appended pod underwater mount according to the present invention.

FIG. 11 is provided to address the issues of system integration and operation. Both will be influenced by the particular application selected for the appended pod underwater gun mount 22. A simplified system diagram is provided, showing the appended pod underwater gun mount 22 used as part of a sub-system to an existing Torpedo Defense System (TDS) 60 to provide the adjunct capability of anti-torpedo gunfire. Operator control 58 is exercised via the torpedo defense system 60. That is, a gunfire sub-system is brought to ready status and ordered to respond to appropriate detection and classification criteria by personnel in charge of the overall torpedo defense functions. A fire control computer 62 is shown for processing sensor information 56 regarding the torpedo's position, and developing launcher and firing orders 64 that will aim and fire the weapon(s) in the most effective manner. Included in those computations would be the transfer of control from one gun to another, and the coordination of more than one gun for simultaneous engagement. In the example diagram, the appended pod underwater gun mount fire control computer 62 is shown to be separate from the torpedo defense system 60, but its functions could easily be integrated within the TDS processors.

Interface signals between the fire control computer 62 and the appended pod 22 are similar to those of traditional naval weapon systems. The position and status 68 of the weapon and launcher, or appended pod 22, are fed back continually to the fire control computer 62, while launcher orders, including train and tilt data 66 and compensation data 70 for ship motion are transmitted to the launcher. Firing orders 64 from the fire control computer 62 determine actuation of the gun(s) in the appended pod underwater gun mount 22.

Accordingly, the present invention provides a remote controlled gun mount configured as a streamlined, hydrodynamic compatible module, for use underwater. Further, the underwater gun mount defined in this disclosure is unique in that it is configured as an elongated streamlined pod, similar in shape to a torpedo or a paravane, thereby presenting minimum resistance to hydrodynamic flow when oriented in its ready-for-action position, where the gun mount longitudinal axis is held parallel to the direction of motion of the host vessel. Traditional shipboard enclosed gun mounts are typically configured as circular dome shaped structures or rotating box forms. Further, the device of the present invention enables the use of guns to direct an unobstructed line of fire at objects, underwater, closing from astern of a host vessel and the concept of mounting a fully controllable gun mount offset from the hull of the host vessel is unique. Guns located within such a mount will provide a clear line of fire towards torpedoes attacking from astern. Because of the offset mount configuration, ship screws, propulsors, control surfaces, and the ship's wake will not obstruct defensive ordnance launched in that critical direction.

Even further, since the preferred embodiment of this invention provides two gun mount pods near the stern of the host vessel, one on either side, it is possible to engage an attacking torpedo with converging or intersecting streams of gunfire, thereby increasing the probability of a successful engagement. The invention enables simultaneous use of two gun mounts against an advancing torpedo.

Because of the dual mount configuration, there is builtin redundancy that will increase the availability of the TDS to respond to a torpedo threat, despite possible system casualty or degradation.

The streamlined pod housing of the gun mount facilitates installation of both forward and aft firing weapons within the same enclosure. Forward facing guns mounted in appended stern pods can fire directly ahead and in an arc to the outboard side of centerline ship structures such as the submarine "sail". On a submarine, the narrow, undefended zone directly ahead of the vessel can be eliminated by the option of mounting a third pod forward of the "sail", which will result in protection against an incoming torpedo by the combination of as many as three underwater gun mounts (see FIG. 7).

The invention is unusual in that it is applicable to both submarines and to surface ships. In addition, the underwater gun mount pods are accessible, above the water, for servicing, when not deployed. In a submarine application, the pod mounts are fixed structures that are above the ship's hull when surfaced. In a surface ship installation, the pod mounts are configured to be withdrawn to an on-board stowed position when not required. Finally, the device is configurable as a remote controlled external mount for containment and launch of anti-air and anti-surface ordnance from submarines. As described above, a viable alternative application of the underwater pod mount is to support the deployment of gun fired projectiles or small missiles against aircraft or surface craft operating above a submerged submarine that is at shallow depth. Typical targets would be anti-submarine helicopters, or surface craft at ranges too close to be engaged with anti-ship torpedoes. The pod mount could also be used to launch countermeasures, sonobuoys, or other devices that need to be deployed underwater from a ship or submarine.

The final configuration of the appended pod underwater gun mount will depend upon the particular application for which it is selected. A streamlined, hydrodynamic form is specified, but the exact design of the pod to achieve maximum compatibility with a ship or submarine of a specific class is a function of engineering design associated with implementation. Also, the design of the strut or extender arm that holds it away from the host platform is subject to refinement. It is acknowledged that variations in methods, materials, and construction may be applied towards achievement of the concepts disclosed herein, while maintaining the functional qualities of the invention.

Accordingly, it is anticipated that the invention herein will have far reaching applications other than those of underwater or above water vehicles described, and any such modification is intended to be included herein.

This invention has been disclosed in terms of certain embodiments. It will be apparent that many modifications can be made to the disclosed apparatus without departing from the invention. Therefore, it is the intent of the appended claims to cover all such variations and modifications as come within the true spirit and scope of this invention.

What is claimed is:

1. An appended pod gun mount comprising:

a strut member having a base end and a distal end;

an ammunition housing moveably fixed to the distal end of said strut member;

a gun member integrally connected to said ammunition housing;

a train control mechanism positioned between said strut member and said ammunition housing for controlling a horizontal rotation of said ammunition housing with respect to the distal end of said strut member;

a tilt control mechanism positioned between said strut member and said ammunition housing for controlling a vertical rotation of said ammunition housing with respect to the distal end of said strut member; and a flexible boot for protecting each of said train control mechanism and said tilt control mechanism.

2. The appended pod gun mount according to claim 1 wherein said ammunition housing further comprises:

at least one forward facing gun barrel;

at least one aft facing gun barrel; and at least one ammunition magazine positioned between the forward facing gun barrel and the aft facing gun barrel.

3. The appended pod gun mount according to claim 1 wherein:

said flexible boot is connected to said ammunition housing; and said ammunition housing is substantially cylindrical in shape.

4. The appended pod gun mount according to claim 1 wherein said pod tilt control mechanism is positioned immediately adjacent said ammunition housing.

5. The appended pod gun mount according to claim 1 wherein said pod train control mechanism is positioned immediately adjacent said strut member.

6. The appended pod gun mount according to claim 1 wherein said flexible boot is waterproof.

7. The appended pod gun mount according to claim 1 wherein an angle between the base end of said strut member and the distal end thereof is at least 30 degrees.

8. The appended pod gun mount according to claim 1 wherein an angle between the base end of said strut member and the distal end thereof is no more than 45 degrees.

9. The appended pod gun mount according to claim 1 wherein said pod tilt control mechanism imparts a tilt of at least 30 degrees to said ammunition housing.

10. The appended pod gun mount according to claim 1 wherein said pod train control mechanism imparts a train rotation of at least 30 degrees to said ammunition housing.

11. The appended pod gun mount according to claim 1 wherein said pod train control mechanism and said pod tilt control mechanism are actuable to both train and tilt said ammunition housing at the same time.

12. An appended pod underwater gun mount for a submersible host vessel comprising:

a strut member having a base end fixed to an outer hull of said submersible host vessel and a distal end protruding outwardly from said host vessel;

an ammunition housing moveably fixed to the distal end of said strut member;

a gun member integrally connected to said ammunition housing;

a train control mechanism positioned between said strut member and said ammunition housing for controlling a horizontal rotation of said ammunition housing with respect to the distal end of said strut member;

a tilt control mechanism positioned between said strut member and said ammunition housing for controlling a vertical rotation of said ammunition housing with respect to the distal end of said strut member; and a flexible boot for protecting each of said train control mechanism and said tilt control mechanism.

13. The appended pod underwater gun mount according to claim 12 wherein said strut assembly and appended pod underwater gun mount are serviceable above water when said submarine is surfaced.

14. The appended pod underwater gun mount according to claim 12 wherein said submarine host vessel supports at least one appended pod underwater gun mount.

15. The appended pod underwater gun mount according to claim 12 wherein said submarine host vessel supports a plurality of appended pod underwater gun mounts.

16. The appended pod underwater gun mount according to claim 15 wherein said plurality of appended pod underwater gun mounts provide a field of fire coverage to protect the entire stern area of said host vessel.

17. The appended pod underwater gun mount according to claim 15 wherein said plurality of appended pod underwater gun mounts provide a field of fire coverage to protect the entire forward area of said host vessel.

18. The appended pod underwater gun mount according to claim 12 wherein said ammunition housing will support deployment of a plurality of attack and defense mechanisms.

19. An appended pod gun mount for a surface host vessel comprising:

an extendable arm member having a base end fixed to an outer hull of said surface host vessel and a distal end protruding outwardly from said host vessel;

an ammunition housing moveably fixed to the distal end of said arm member;

a gun member integrally connected to said ammunition housing;

a train control mechanism positioned between said arm member and said ammunition housing for controlling a horizontal rotation of said ammunition housing with respect to the distal end of said arm member;

a tilt control mechanism positioned between said arm member and said ammunition housing for controlling a vertical rotation of said ammunition housing with respect to the distal end of said arm member; and a flexible boot for protecting each of said train control mechanism and said tilt control mechanism.

20. The appended pod gun mount of claim 19 wherein the base end is pivotally fixed to a deck portion of the outer hull to facilitate stowage of the appended pod gun mount above water.

21. A system for controlling an appended pod underwater gun mount in connection with a host vessel, said system comprising:

an operator interface; and a fire control computer responsive to said operator interface, said fire control computer supplying firing information to said appended pod underwater gun mount, including pod position and orientation, pod mount train and tilt orders, pod mount stabilization orders, and gun firing orders.

22. The system according to claim 21 wherein said operator interface supplies at least torpedo bearing information and pod control information to said fire control computer.

23. The system according to claim 21 wherein said fire control computer additionally processes information relating to motion of said host vessel.

* * * * *